US007871493B2

(12) United States Patent
Hermans et al.

(10) Patent No.: US 7,871,493 B2
(45) Date of Patent: Jan. 18, 2011

(54) ENVIRONMENTALLY-FRIENDLY TISSUE

(75) Inventors: Michael Alan Hermans, Neenah, WI (US); David Vincent Spitzley, Appleton, WI (US); Daniel Scott Westbrook, Sherwood, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 415 days.

(21) Appl. No.: 12/215,492

(22) Filed: Jun. 26, 2008

(65) Prior Publication Data

US 2009/0321027 A1 Dec. 31, 2009

(51) Int. Cl.
*D21F 11/14* (2006.01)

(52) U.S. Cl. ..... 162/115; 162/117; 162/118; 162/203; 162/205; 162/207

(58) Field of Classification Search ..... 162/109, 162/111, 115, 117–118, 203
See application file for complete search history.

(56) References Cited

U.S. PATENT DOCUMENTS

| | | | |
|---|---|---|---|
| 4,925,531 | A | 5/1990 | Koski |
| 5,196,091 | A | 3/1993 | Hergert |
| 5,316,383 | A | 5/1994 | Begemann et al. |
| 5,494,554 | A | 2/1996 | Edwards et al. |
| 5,498,316 | A | 3/1996 | Kraft |
| 5,672,248 | A | 9/1997 | Wendt et al. |
| 5,674,364 | A | 10/1997 | Pitkajarvi |
| 5,814,191 | A | 9/1998 | Huovila |
| 6,077,590 | A | 6/2000 | Archer et al. |
| 6,080,279 | A | 6/2000 | Hada et al. |
| 6,083,346 | A | 7/2000 | Hermans et al. |
| 6,096,169 | A | 8/2000 | Hermans et al. |
| 6,143,135 | A | 11/2000 | Hada et al. |
| 6,187,137 | B1 | 2/2001 | Druecke et al. |
| 6,197,154 | B1 | 3/2001 | Chen et al. |
| 6,228,220 | B1 | 5/2001 | Hada et al. |
| 6,306,258 | B1 | 10/2001 | Lange et al. |
| 6,440,267 | B1 | 8/2002 | Rekoske et al. |
| 6,454,904 | B1 | 9/2002 | Hermans et al. |
| 6,497,789 | B1 | 12/2002 | Hermans et al. |
| 6,849,157 | B2 | 2/2005 | Farrington, Jr. et al. |

(Continued)

FOREIGN PATENT DOCUMENTS

EP 1295986 A1 * 3/2003

(Continued)

OTHER PUBLICATIONS

"GHG Emissions from Fuel Use in Facilities," Version 3.0, World Resources Institute, Dec. 2007, 5 pages.

(Continued)

*Primary Examiner*—José A Fortuna
(74) *Attorney, Agent, or Firm*—Michael J. Sullivan; Gregory E. Croft

(57) ABSTRACT

A method of making an environmentally-friendly tissue sheet for conversion into a single-ply roll product, such as bath tissue or paper towels, is disclosed. The method utilizes numerous process aspects that are determined to minimize energy consumption, which is about 100 grams $CO_2$ equivalent emissions or less per 38 square feet of tissue, while at the same time producing a tissue roll product having desirable roll bulk, firmness and absorbency.

13 Claims, 2 Drawing Sheets

U.S. PATENT DOCUMENTS

| | | | | |
|---|---|---|---|---|
| 6,887,348 | B2 | 5/2005 | Hermans et al. | |
| 6,921,460 | B2 | 7/2005 | Hermans et al. | |
| 6,998,024 | B2 | 2/2006 | Burazin et al. | |
| 7,166,189 | B2 | 1/2007 | Burazin et al. | |
| 2003/0155089 | A1 | 8/2003 | Anderson et al. | |
| 2004/0011485 | A1 | 1/2004 | Kumar et al. | |
| 2005/0079361 | A1 | 4/2005 | Hamed et al. | |
| 2007/0131366 | A1 | 6/2007 | Underhill et al. | |
| 2008/0099169 | A1 | 5/2008 | Beuther et al. | |
| 2009/0183846 | A1 * | 7/2009 | Hermans et al. | 162/109 |
| 2009/0321027 | A1 * | 12/2009 | Hermans et al. | 162/111 |

FOREIGN PATENT DOCUMENTS

| | | | |
|---|---|---|---|
| EP | 1 027 493 | B1 | 10/2004 |
| WO | WO 9923300 | A1 * | 5/1999 |
| WO | WO 9923302 | A1 * | 5/1999 |
| WO | WO 2005/116330 | A1 | 12/2005 |

OTHER PUBLICATIONS

"Indirect CO2 Emissions from the Consumption of Purchased Electricity, Heat, and/or Steam," Guide to Calculation Worksheets, A WRI/WBCSD GHG Protocol Initiative Calculation Tool, Version 1.2, Jan. 2007, pp. 1-14.

"Calculation Tool for Direct Emissions from Stationary Combustion Calculation Worksheets," A WRI/WBCSD Calculation Tool, Version 3.1, Dec. 2007, 25 pages.

Gillenwater, Michael, "Calculation Tool for Direct Emissions from Stationary Combustion," Version 3.0, A WRI/WBCSD GHG Protocol Guidance Tool, Jul. 2005, pp. 1-94.

Ranganathan, J. et al., "The Greenhouse Gas Protocol—A Corporate Accounting and Reporting Standard," Revised Edition, World Resources Institute and World Business Council for Sustainable Development, Mar. 2004, 116 pages.

* cited by examiner

ENVIRONMENTALLY-FRIENDLY TISSUE

BACKGROUND OF THE INVENTION

Different tissue making processes have different advantages and disadvantages in terms of the product they produce and the impact of such production on the environment. Processes such as throughdrying are able to offer a high bulk roll and thus minimize fiber usage, but consume a fair amount of fossil fuel energy and hence have a large carbon dioxide footprint as represented by the $CO_2$ equivalent emissions. Other processes, such as wet-pressed processes, consume far less energy, but are unable to produce a roll with high bulk and hence low fiber utilization. Since both energy consumption and fiber usage have environmental affects, neither process offers an environmentally-friendly tissue roll. With increased interest in environmental issues, both in the United States and around the globe, a tissue product with minimal environmental impact would be a desirable product offering.

SUMMARY OF THE INVENTION

It has now been discovered that an environmentally-friendly tissue roll product can be made with very desirable properties. More particularly, a tissue roll product can be made with throughdried-like properties, but using a more energy-efficient process that combines a large number of specific features, each of which has been determined to minimize the $CO_2$ equivalent emissions (hereinafter defined), while simultaneously imparting characteristics to the tissue web or sheet that result in a high quality tissue roll product.

Hence, in one aspect, the invention resides in a method of making a roll of tissue comprising: (a) forming a wet tissue web from an aqueous suspension of papermaking fibers, said papermaking fibers having a Water Retention Value of about 1.5 grams of water or less per gram of fiber; (b) dewatering the wet web to a consistency from about 50 to about 65 percent of the Water Retention Consistency of the wet web; (c) transferring the dewatered web to a molding fabric, wherein the dewatered web conforms to the surface of the molding fabric to form a molded wet web; (d) transferring the molded wet web to the surface of a hooded Yankee dryer; (e) drying the web to a consistency of about 90 percent or greater and creping the dried web to produce a tissue sheet having a basis weight from about 25 to about 40 grams per square meter, a Formation Index of about 110 or greater, and a Vertical Water Absorbent Capacity of about 9 grams of water or greater per gram of fiber, wherein the total $CO_2$ equivalent emissions per 38 square feet of tissue used for dewatering and drying the tissue sheet is from about 60 to about 100 grams; and (f) converting the tissue sheet into a roll of single-ply tissue having a roll bulk of about 10 cubic centimeters or greater per gram of fiber.

In another aspect, the invention resides in a method of making a roll of tissue comprising: (a) forming a wet tissue web from an aqueous suspension of papermaking fibers using a twin-wire former, said papermaking fibers having a Water Retention Value of about 1.5 grams of water or less per gram of fiber; (b) dewatering the wet web with a multi-zoned air press to a consistency from about 50 to about 65 percent of the Water Retention Consistency of the wet web; (c) transferring the dewatered web to a molding fabric, wherein the dewatered web conforms to the surface of the molding fabric to form a molded wet web; (d) transferring the molded wet web to the surface of a hooded Yankee dryer with a pressing pressure of about 5 pounds or less per square inch of the web; (e) drying the web to a consistency of about 95 percent or greater and creping the dried web to produce a tissue sheet having a basis weight from about 25 to about 40 grams per square meter, a Formation Index of about 120 or greater, and a Vertical Water Absorbent Capacity of about 9 grams of water or greater per gram of fiber, wherein the total $CO_2$ equivalent emissions per 38 square feet of tissue used for dewatering and drying the tissue sheet is from about 60 to about 100 grams; and (f) converting the tissue sheet into a roll of single-ply tissue having a roll bulk of about 10 cubic centimeters or greater per gram of fiber.

DEFINITIONS

For purposes herein, the following terms will have the following meanings.

An "air press" is an apparatus which applies pressurized air to one side of a wet web in order to drive water out of the web. For purposes herein, a vacuum may optionally be applied to the opposite side of the web to assist in water removal, but the amount of vacuum is to be minimized because the energy need to create a pressure differential using vacuum is greater than that needed to create the same pressure differential using pressurized air. If vacuum is used, it should be about 5 inches of mercury or less. For purposes of this invention, the air press is preferably a multi-zoned air press, meaning that there are two or more distinct zones within the air press that apply incrementally increasing pressures to the web during dewatering. While any number of multiple zones can be used, such as two, three, four, five or more, a particularly suitable number of zones is three based on cost/benefit reasons.

"Basis weight" is the amount of bone dry fiber in the tissue sheet, expressed as grams per square meter (gsm) of tissue surface. The basis weight of the tissue sheets of this invention can be about 25 grams or greater per square meter, more specifically from about 25 to about 60 gsm, more specifically from about 25 to about 45 gsm, and still more specifically from about 30 to about 40 gsm.

The "$CO_2$ equivalent" emissions associated with fossil fuel burning is a universal measure of the combined radiative forcing effects of air pollutants relative to carbon dioxide. This quantity indicates the global warming potential (GWP) of each of the six greenhouse gases created by fuel burning, expressed in terms of the GWP of one unit of carbon dioxide. It is widely used to evaluate the release (or avoided release) of different greenhouse gases against a common basis. The $CO_2$ equivalent emissions are calculated according to the Greenhouse Gas Protocol guidance documents (see Ranganathan, J. et al., The Greenhouse Gas Protocol—A Corporate Accounting and Reporting Standard, Revised Edition, World Resources Institute and World Business Council for Sustainable Development, March 2004, herein incorporated by reference). This calculation involves first determining the carbon-containing fuel consumed in a production process (for tissue manufacture, natural gas is the only fuel meeting this definition). This quantity of fuel is multiplied by the appropriate emission factor to determine the direct $CO_2$ equivalent emissions (also called Scope 1 emissions) from the production process. See "GHG Emissions from Fuel Use in Facilities", Version 3.0, World Resources Institute, December 2007, herein incorporated by reference. For the United States in 2007, this emission factor is 123 pounds $CO_2$ per 1,000,000 BTU. The electricity-related indirect emissions (Scope 2 emissions) associated with the production process are calculated based on the quantity of electricity used in the process and the emission factor provided for electricity generation. For the United States in 2005, this emission factor is 1263 pounds $CO_2$ per 1000 KWh as reported by "Indirect $CO_2$ Emissions from Purchased Electricity", Version 3.0, World Resources Institute, December 2007, herein incorporated by reference. As used herein, all $CO_2$ equivalent emissions values are based on the foregoing emission factors. To the extent published emission factors change over time, the foregoing emission factors shall control and apply in interpreting the scope of this invention.

For purposes herein, the total quantity of $CO_2$ equivalent emissions is the sum of the Scope 1 and Scope 2 $CO_2$ equivalent emissions values for the dewatering/drying energy used for the tissue machine only and does not account for energy due to machine drives, lighting, heating and other associated areas, such as converting operations. In addition, the $CO_2$ equivalent emissions "per 38 square feet of tissue" is based on a 300 sheet count roll with sheets having a width of 4.5 inches and a length of 4.09 inches. (300×(4.5 inches/12 inches per foot)×(4.09 inches/12 inches per foot)=38.3 square feet.) By specifying the $CO_2$ equivalent emissions on a square footage basis, it is applicable to any tissue manufacturing method and product.

In accordance with this invention, the sum of the dewatering and drying $CO_2$ equivalent emissions per 38 square feet of tissue can be about 100 grams or less, more specifically from about 60 or 70 to about 100 grams, more specifically from about 60 or 70 to about 90 grams, and still more specifically from about 60 or 70 to about 80 grams. For the dewatering operations alone (pre-Yankee dryer) of the method of this invention, the $CO_2$ equivalent emissions per 38 square feet of tissue can be about 5 grams or less, more specifically from about 1 to about 5 grams, more specifically from about 1 to about 3 or 4 grams. Because the dewatering energy usage is so low, the $CO_2$ equivalent emissions per 38 square feet of tissue for the drying operations alone (Yankee dryer/hood) are about the same as the sum total above. Specifically, the $CO_2$ equivalent emissions per 38 square feet of tissue for the drying operations can be about 100 grams or less, more specifically from about 60 or 70 to about 100 grams, more specifically from about 60 or 70 to about 90 grams, and still more specifically from about 60 or 70 to about 80 grams.

"Converting" refers to the post tissue sheet manufacturing operations. Converting processes are well known in the tissue making art. Normally, immediately after being dried, the tissue sheet is wound into a large parent roll and transferred to storage. At some time thereafter, the parent roll is unwound and the tissue sheet is slit, attached to a core and rewound into the final tissue roll product. Subsequently the roll product is packaged. Optional intermediate operations include embossing, printing and/or spraying chemical additives onto the sheet. For purposes herein, all of the processing steps after the tissue sheet is removed from the Yankee dryer fall within the umbrella of "converting". Although converting is not part of the energy consumption aspects of this invention, converting can play a roll in the ultimate roll properties. In particular, the winding operations will impact the roll firmness of the final product, such as be reducing winding tension while building the roll. These operations are well known and understood by those skilled in the art and providing a tissue roll product with the requisite roll bulk and firmness can be easily accomplished starting with the high bulk creped tissue sheet produced in the manufacturing operations in accordance with this invention.

The "Formation Index" is a measure of the uniformity of the fiber structure of the tissue sheet. It has been determined that tissue sheets that are more uniformly formed can minimize energy consumption during drying. The method for determining the Formation Index is described in U.S. Pat. No. 6,440,267, which is hereby incorporated by reference for that purpose. The Formation Index of the tissue sheets of this invention can be about 110 or greater, more specifically from about 120 to about 170, and still more specifically from about 130 to about 150.

A "molding fabric" is a highly textured, 3-dimensional fabric that imparts significant caliper and bulk to the tissue sheet. Such molding fabrics are well known in the art and have tissue-contacting surfaces with elevational differences of about 0.005 inch (0.12 millimeter) or greater. Such fabrics are disclosed, for example, in U.S. Pat. No. 5,672,248, U.S. Pat. No. 6,998,024, U.S. Pat. No. 7,166,189 and U.S. Patent Application No. 2007/0131366(A1), all of which are hereby incorporated by reference.

The "roll bulk" of a tissue product is simply the volume of the product roll, excluding the core volume, divided by the weight of the tissue on the roll. Roll bulk is expressed in cubic centimeters per gram of tissue (cc/g). The roll products of this invention can have a roll bulk of about 10 cubic centimeters or greater per gram, more specifically from about 10 to about 25 cc/g, more specifically from about 10 to about 20 cc/g, and still more specifically from about 15 to about 20 cc/g.

The "roll firmness" of a roll of tissue is a measure of the roll's resistance to deformation by a probe under an applied load. Roll firmness is expressed in millimeters (mm), which represents the extent to which the probe penetrates the surface of the roll. Hence softer rolls, which allow the probe to penetrate further into the roll, have greater roll firmness values. Conversely, more firm rolls, which do not allow the probe to penetrate very far into the roll, have lesser roll firmness values. The procedure for measuring roll firmness is described in U.S. Pat. No. 6,077,590, which is hereby incorporated by reference for that purpose. The roll products of this invention can have a roll firmness value of about 8 millimeters (mm) or less, more specifically from about 4 to about 8 mm, and still more specifically from about 6 to about 8 mm.

While any type of former can be used to form the wet tissue web, twin-wire formers are particularly desirable for purposes herein because they provide the most uniform web formation which, as mentioned above, has a beneficial impact on energy usage during dewatering and drying of the web. A "twin-wire former" is a well known forming unit within the tissue making art. It involves injecting the fiber furnish suspension from the headbox between converging forming wires as the wires pass around a forming roll. Water is expelled through one of the forming wires and the newly-formed wet web of fibers is retained on the other forming wire and carried to the dewatering section of the papermaking machine. A suitable twin-wire former is disclosed in U.S. Pat. No. 4,925,531 and U.S. Pat. No. 5,498,316, both of which are herein incorporated by reference. However, other formers can also be used, such as crescent formers, suction breast roll formers, Fourdrinier formers and the like.

The "Water Retention Value" (WRV) is the amount of water naturally retained by fibers, expressed as grams of water per gram of fiber (g/g). The Water Retention Value is described in U.S. Pat. No. 6,096,169, which is hereby incorporated by reference for that purpose. The WRV for papermaking fibers suitable for purposes of this invention should be low in order to more easily dewater the fibers with less energy. More specifically, the WRV can be about 1.5 grams of water or less per gram of fiber, more specifically from about 1.0 to about 1.5 g/g, more specifically from about 1.2 to about 1.4 g/g, and still more specifically from about 1.3 to about 1.4 g/g.

The "Water Retention Consistency" (WRC) is the consistency of the web (weight percent fibers) when the fibers of the web are at their Water Retention Value. Arithmetically, the WRC=100/(1+WRV). The WRV for a papermaking furnish consisting of more than one type of fiber is the weighted average of the WRV for the individual fiber type components. By way of example, if the furnish consists of 50% fiber component "A" having a WRV of 1.33 g/g and 50% fiber component "B" having a WRV of 1.41 g/g, the furnish WRV is 0.5 (1.33)+0.5 (1.41)=1.37 g/g. The furnish WRC is 100/(1+1.37) or 42.2 percent consistency.

In the interests of brevity and conciseness, any ranges of values set forth in this specification contemplate all values within the range and are to be construed as written description support for claims reciting any sub-ranges having endpoints which are whole number or otherwise of like numerical values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Similarly, a disclosure in this specification of a range from 0.1 to 0.5 shall be considered to support claims to any of the following ranges: 0.1-0.5; 0.1-0.4; 0.1-0.3; 0.1-0.2; 0.2-0.5; 0.2-0.4; 0.2-0.3; 0.3-0.5; 0.3-0.4; and 0.4-0.5. In addition, any values prefaced by the word "about" are to be construed as written description support for the value itself. By way of example, a range of "from about 1 to about 5" is to be interpreted as also disclosing and providing support for a range of "from 1 to 5", "from 1 to about 5" and "from about 1 to 5".

DETAILED DESCRIPTION OF THE DRAWING

Figure 1:
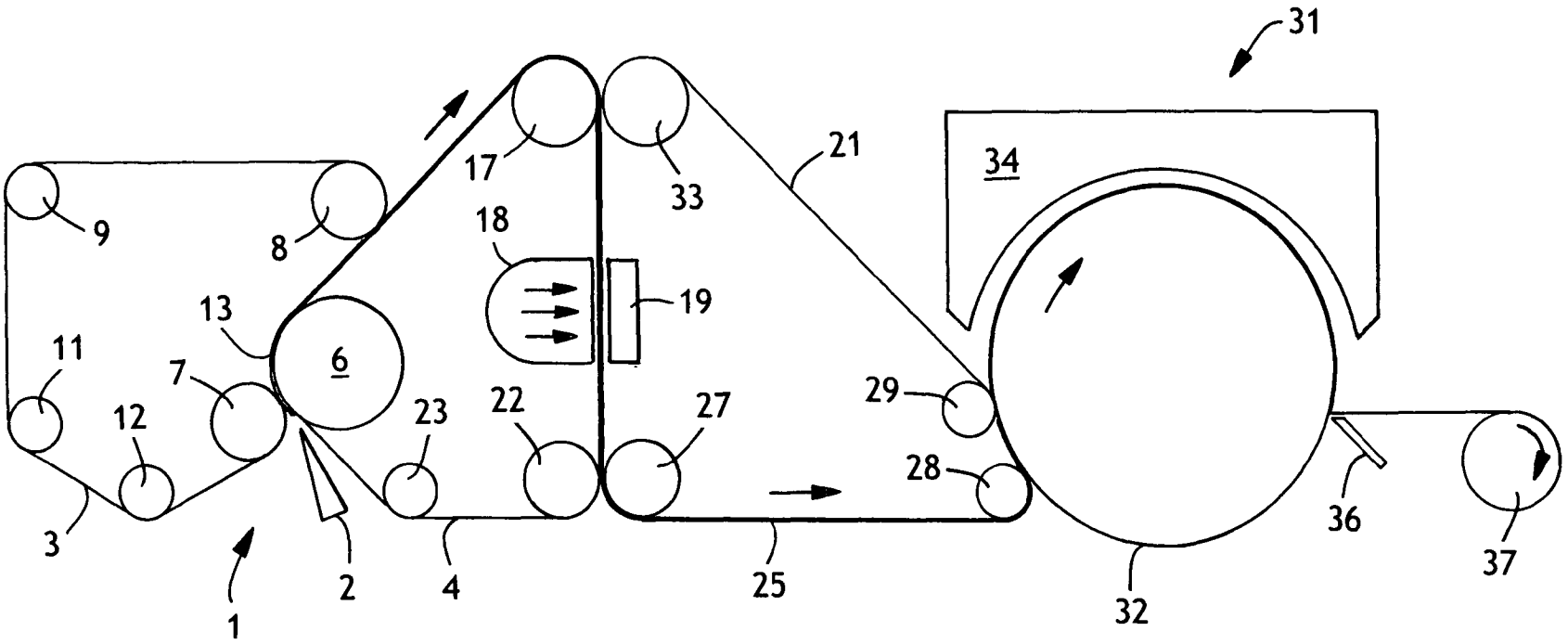
FIG. 1 is a schematic illustration of a process in accordance with this invention.

Referring to FIG. 1, a process in accordance with this invention will be described. Shown is a twin wire former 1 comprising a headbox 2 which injects an aqueous suspension of papermaking fibers between a first forming fabric 3 and a second forming fabric 4. Suitable papermaking fibers for purposes herein advantageously include recycled papermaking fibers, although virgin papermaking fibers can also be used. The headbox can be a mono-layer or multi-layer headbox. Consistency dilution may be useful for achieving the requisite formation level. Consistency dilution is described in U.S. Pat. No. 5,196,091, U.S. Pat. No. 5,316,383, U.S. Pat. No. 5,814,191 and U.S. Pat. No. 5,674,364, all of which are herein incorporated by reference. Also shown is the forming roll 6, breast roll 7, return roll 8, and guide rolls 9, 11 and 12. During formation, water is removed through the first forming fabric by centrifugal force as the path of the web passes around the periphery of the forming roll. The newly-formed web 13 is carried away from the former by the second forming fabric 4.

The newly-formed web, supported by the second forming fabric, is carried past guide roll 17 and further dewatered, preferably using an air press 18, preferably without the aid of vacuum boxes in the dewatering zone. Advantageously, a collection system or device 19 resides opposite the air press to collect the mixture of air and water being expelled from the wet web. The collection system should utilize little or no vacuum so as to minimally increase or not increase the energy consumption. The collection system is not a vacuum box in the normal sense of providing motive force for dewatering the web as in a standard tissue machine vacuum box.

The air press utilizes pressurized air (shown as arrows in FIG. 1) to dewater the web, which serves to minimize the energy used in dewatering the web. The energy required to produce the necessary pressurized air is less than the energy required to provide the same pressure drop across the web via vacuum. As each vacuum box contributes to the $CO_2$ equivalent emissions, the use of vacuum on the wet-end of the tissue machine should be minimized, if not eliminated. For the inventive process described herein, the air press is operated in such a manner that the web is dewatered by the air press alone from the post-forming consistency to approximately 50-60% of the web water retention consistency (WRC). In particular, the degree of dewatering must not exceed 65 percent of the web WRC.

As the web is dewatered in the air press, it is simultaneously transferred from the second forming fabric to a 3-dimensional molding fabric 21. The second forming fabric returns to the forming unit via return roll 22 and guide roll 23. Upon transfer to the molding fabric in the air press, the dewatered web is conformed to the surface of the molding fabric by the pressurized air to provide the resulting molded web with a 3-dimensional topography, which ultimately will provide the tissue sheet with a high degree of caliper and bulk.

After transfer to the molding fabric, the molded web 25 is carried by the molding fabric around roll 27 and transferred to a hooded Yankee dryer 31 using a long wrap transfer. The long wrap transfer is achieved using a pair of pressure rolls 28 and 29, which serve to gently press the molded web against the hot Yankee dryer cylinder surface 32. After the transfer, the molding fabric returns to the air press via return roll 33. The molded web is pressed onto the Yankee dryer cylinder at low pressing pressures, in the range from about 1 to about 5 pounds per square inch (psi) in order to minimize compression of the web in order to maintain the highest possible bulk. Any suitable creping adhesive, as are well known in the art, may be used to augment adhesion of the molded web to the Yankee dryer cylinder.

The web is then dried by the combination of the Yankee dryer cylinder and the Yankee dryer hood 34 to a consistency of about 90 percent or greater, more specifically about 95 percent or greater. This combination of drying operations is again operated in a manner to minimize energy consumption, with the cylinder/hood drying balance skewed to do the maximum possible drying via the cylinder. The Yankee cylinder uses far less energy and hence produces far less $CO_2$ equivalent emissions per pound of water evaporated than does the Yankee hood. (The Yankee cylinder can remove water by conductive drying using roughly 1800 BTUs per pound of water, while the Yankee hood uses approximately 2300 BTU/pound of water.) This is largely because the hood must circulate the humid air stream and discharge the air at a high velocity to dry the sheet. The Yankee cylinder is more energy efficient in terms of drying, but is generally not able to achieve a high drying rate without the assistance of the hood. Since the objective is to minimize dryer $CO_2$ emissions, the system must be operated such that the hood does a significant amount of the water removal while removing as much water as possible via the Yankee dryer cylinder.

Upon being dried, the web is dislodged (creped) from the Yankee dryer surface with a doctor blade 36 and wound, if desired, into a parent roll 37 for further converting operations into standard rolls of tissue.

Figure 2:
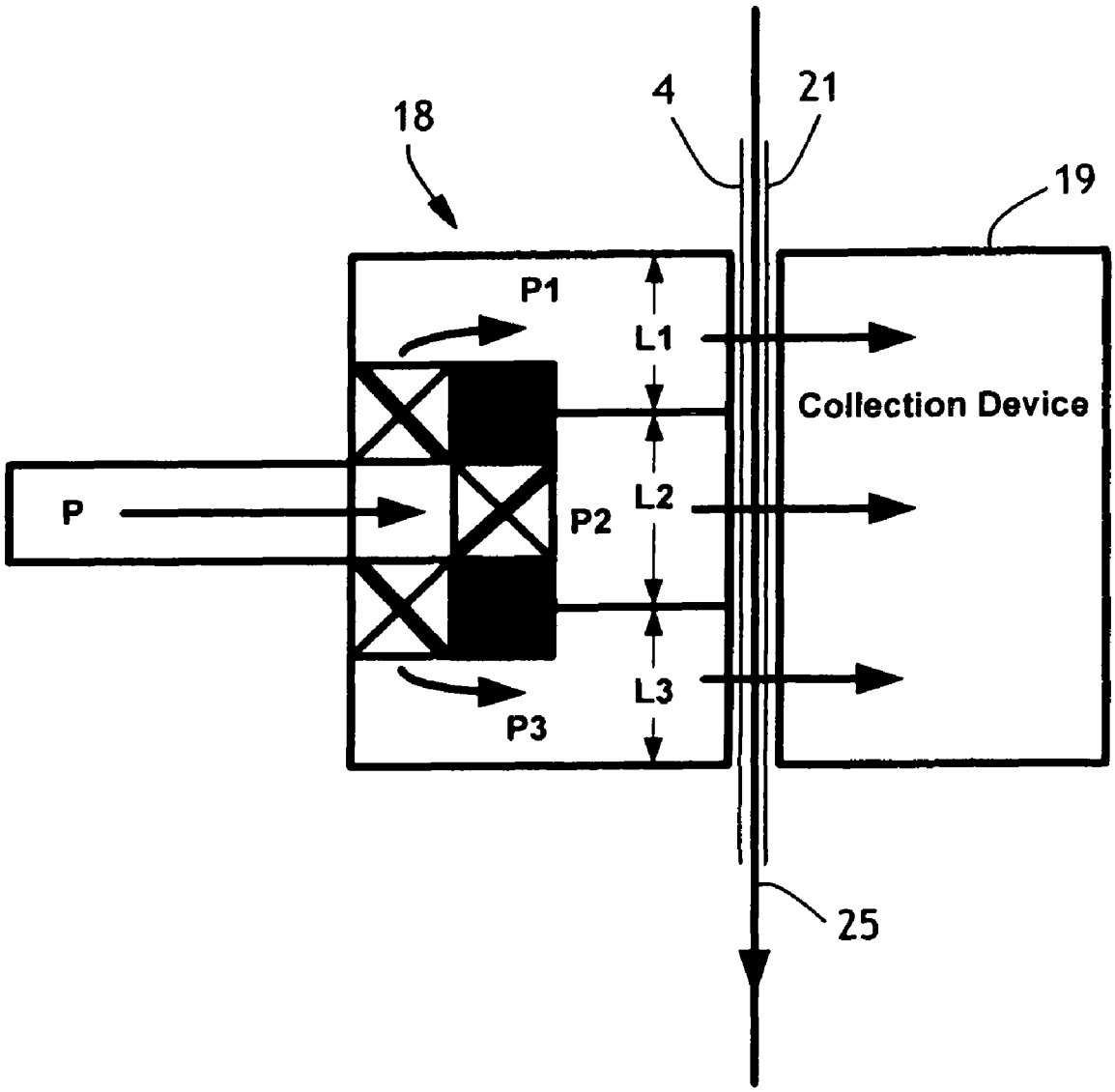
FIG. 2 is a schematic illustration of a multi-zone air press useful for purposes of this invention.

FIG. 2 is a schematic illustration of a three-zoned air press which can be used in accordance with this invention. The air entering the air press enters at a pressure P which is at least equal to the pressure in the highest pressure zone of the air press, the pressure in zone 3. Each zone is connected to the supply by a regulator which can be used to adjust the pressure in each zone. To minimize energy consumption and allow for a transfer of the web to the high topography fabric without making pinholes, the pressure in zone 1 (P1) is low, perhaps 4 psig. This section serves to dewater the web using minimal energy while assuring a good transfer of the web without pinhole creation.

Next the web passes under the second zone where the pressure P2 is greater than or equal to the pressure P1. The pressure in this zone could be 6 psig, allowing for additional dewatering with minimal increase in energy consumption. Finally, the web passes to zone 3 operated at pressure P3, which is in turn preferably greater than the pressure in zones 1 and 2. Here maximum dewatering is done in order to bring the web to the desired pre-Yankee consistency. As the web has already been transferred to the 3-dimensional impression fabric, pinhole creation is less of a concern at this point, though the maximum acceptable pressure may still be limited by the characteristics of the impression fabric. The higher pressure requires more energy than the previous zones, but increases the web consistency to a higher level.

The lengths of the zones, L1 through L3, may be varied to optimize the tradeoff between energy consumption and web consistency while maintaining a pinhole-free web. If pinholes are created, air will preferentially flow through the pinholes, wasting energy without increasing web consistency and also producing a less-desirable product. L1, L2 and L3 may be equal in length or the length of any zone may be lower than the length of the other zones.

If desired, P3 may match the supply pressure P, though eliminating the need for a regulator, but the regulator or a gate/valve may be utilized to control flow even if a pressure similar to the supply pressure is used for zone 3. In all cases, the use of the gradually increasing pressure is useful for minimizing energy consumption for a given web consistency while maintaining a pinhole-free sheet despite the use of a high-topography impression fabric.

EXAMPLES

Comparative Example 1

Air-Press Dewatering

U.S. Pat. No. 6,096,169 teaches the use of a single-zoned air press. While effective at dewatering a tissue web, this patent teaches dewatering to a relatively high consistency of at least 70 percent of the WRC while using an energy consumption from about 48 to about 156 horsepower (HP)/foot of web width. Unlike the method of this invention as illustrated in Example 5 below, this patent does not teach or suggest the use of a multiple zone air press to transfer the web to a 3-dimensional molding fabric while achieving an energy consumption of approximately 14 HP/foot while dewatering to a consistency of about 50-60% of the WRC.

Translating the standard air press dewatering energy into $CO_2$ equivalent emissions, the amount of $CO_2$ equivalent emissions expected from the standard air press dewatering using about 48 to about 156 HP/foot of web width translates to about 5-17 grams $CO_2$ equivalent emissions per foot of web width when calculated using the web basis weight and machine speed per inventive Example 5 of this application.

In particular, since the dewatering section per Example 5 produces 1.5 grams $CO_2$ equivalent emissions while consuming about 14 HP/foot of sheet width, then the energy consumption of the standard air press dewatering of 48 to 156 HP/foot of web width would produce (48-156 HP/foot of Web width)×1.5 grams of $CO_2$ equivalent emissions/(14 HP per foot of web width) or 5-17 grams $CO_2$ equivalent emissions per foot of web width.

Comparative Example 2

Vacuum Dewatering

Vacuum dewatering is well known in the art associated with the throughdrying process and is an acceptable method for wet-end dewatering of a web. For example, this method is taught in U.S. Pat. No. 6,849,157B2 to Farrington et al and many other patents dealing with the throughdrying process. However, this dewatering technique uses more energy than an air press to achieve the same web consistency.

For example, Table 1 below shows the HP/foot of sheet width requirements for dewatering to the same level (for a given pressure drop) for air press dewatering and vacuum dewatering. In both cases, the pressure drops, air flows and the resulting consistencies would be the same given the same active dewatering area.

TABLE 1

(Pressure Drop/Energy Correlation)

| Pressure drop_(psi) | 4 | 6 | 8 |
|---|---|---|---|
| HP/foot (Air Press) | 60 | 72 | 96 |
| HP/foot (Vacuum) | 120 | 168 | 264 |

It is clear that the energy requirement for vacuum dewatering is always higher than that for air press dewatering. Thus a process relying on vacuum dewatering will require more electrical energy and result in greater $CO_2$ equivalent emissions for a given level of dewatering. For example, as set forth above, at a pressure differential of 6 pounds per square inch (psi), the horsepower requirement for vacuum dewatering is 168 HP/foot versus 72 HP/foot for the air press for the same web consistency. Hence the $CO_2$ equivalent emissions release will be more than double for the vacuum dewatering cases.

Comparative Example 3

Throughdrying

The throughdrying or through-air-drying (TAD) process is capable of producing a roll of tissue with the same desirable product properties as the method of invention with the exception of the $CO_2$ equivalent emissions parameter. The amount of $CO_2$ equivalent emissions release from a TAD process will vary to a small extent with many of the process parameters, but a representative example is found below. This example is based on a 200-inch wide commercial TAD machine, similar to that described in U.S. Pat. No. 6,849,157 B2 to Farrington et al., producing a paper towel with a basis weight of 36.3 gsm at a TAD dryer speed of 4400 feet per minute (fpm). The machine produced metric 15.70 tons of tissue per hour using fabrics and other technology that allow the production of a firm, high-bulk tissue roll product. The $CO_2$ equivalent emissions release is calculated below:

The TAD tissue machine utilized 9.26 MM British Thermal Units (BTU)/metric ton of fiber of gas energy with 1.82 MM BTU/ton going to produce steam for a steam box on the wet end of the machine and the remaining 7.44 MM BTU/metric ton being used for gas in the throughdriers.

(1) 9,260,000 BTU/2200 pounds of fiber=4210 BTU gas usage/pound of fiber.

At 36 gsm, the amount of fiber in 38 $ft^2$ of tissue is calculated as follows:

(2) 36 grams/$m^2$×1 pound/454 grams×(1 meter/1.1 yard)$^2$×(1 yard/3 feet)$^2$×38 $ft^2$/38 $ft^2$=0.277 pounds per 38 $ft^2$ of tissue.

(3) 0.277 pounds per 38 $ft^2$ tissue×4120 BTU/pound=1140 BTU per 38 $ft^2$ tissue.

(4) Then 1140 BTU per 38 $ft^2$ tissue×123 pounds $CO_2$ equivalent emissions per 1,000,000 BTU=0.1402 pounds $CO_2$ equivalent emissions per 38 $ft^2$ of tissue.

(5) 0.1402 pounds $CO_2$ equivalent emissions per 38 $ft^2$ tissue×454 grams/pound=64 grams $CO_2$ equivalent emissions per 38 $ft^2$ tissue for gas energy.

The other major sources of energy were electrical, vacuum for the vacuum boxes and electricity to power the fans.

(6) The vacuum energy was 5000 HP or 0.746 KW/HP×5000=3730 KW.

(7) Since 15.7 metric tons of material was produced per hour, then 15.7 metric tons/hour×2200 pounds/metric ton/3730 KW=9.2 pounds fiber/KW-hour.

(8) 1 KW-hour/9.2 pounds of fiber×0.277 pounds fiber per 38 $ft^2$ tissue×1263 pounds $CO_2$ equivalent emissions/1000 KW-hour electricity=0.0380 pounds $CO_2$ equivalent emissions/38 $ft^2$ tissue.

(9) 0.0380 pounds $CO_2$ equivalent emissions per 38 $ft^2$ tissue×454 grams/pound=17 grams $CO_2$ equivalent emissions per 38 $ft^2$ tissue.

(10) The energy for the supply fan was 416 KW-hour/metric ton of fiber.

(11) The supply fan electrical energy per 38 $ft^2$ tissue is: 416 KW-hour/2200 pounds×0.277 pounds/38 $ft^2$ roll=0.052 KW-hour/38 $ft^2$ tissue.

(12) Then 0.052 KW-hour/38 $ft^2$ tissue×1263 pounds $CO_2$ equivalent emissions/1000 KW-hour=0.0656 pounds $CO_2$ equivalent emissions per 38 $ft^2$ tissue.

(13) 0.0656 pounds $CO_2$ equivalent emissions per 38 $ft^2$ tissue×454 grams/pound=30 grams $CO_2$ equivalent emissions per 38 $ft^2$ of tissue for electrical consumption for the supply fan.

(14) The electricity total $CO_2$ equivalent emissions is then the 17 grams from the vacuum pumps plus the 30 grams from the supply fan or a total of 47 grams $CO_2$ equivalent emissions per 38 $ft^2$ of tissue.

(15) Then the total $CO_2$ equivalent emissions per 38 $ft^2$ tissue for the process equals the gas total of 64 grams per 38 $ft^2$ tissue plus the electricity total of 47 grams per 38 $ft^2$ tissue, or a total of 111 grams $CO_2$ equivalent emissions per 38 $ft^2$ of tissue via the TAD process.

Comparative Example 4

Wet-Pressed Processes

There are numerous wet-pressed processes taught in the art. These processes are characterized by the pressing of water from the web, generally at the transfer of the web to the Yankee dryer. These processes may meet the $CO_2$ equivalent emissions release of the process of this invention, but will generally not simultaneously meet the roll bulk/firmness requirements nor the water absorbency requirements of the products of this invention.

Water absorbency for single-ply wet-pressed tissues are approximately 6 grams/gram or lower. Even two-ply wet-pressed products may not have the specified water absorbency, despite the inter-ply water absorption. For example, Sparkle® towel produced by the Georgia-Pacific Corporation has a water absorbency of approximately 5 grams/gram due to the pressing that occurs in the wet-pressed manufacturing process.

Another wet-pressed process is disclosed in U.S. patent application Ser. No. 11/588,652 to Beuther et al. entitled "Molded Wet-Pressed Tissue". In this process, the web is wet-pressed, but then molded prior to placement on the Yankee dryer. For a two-ply product, the absorbent capacity of a 38 gsm finished product was 6.7 grams/gram. Of course for a single-ply product the absorbent capacity would be lower on a gram/gram basis since there is no inter-ply absorbency for the single-ply product form.

The foregoing examples illustrate the most common tissue processes and the resulting properties. None of these processes and products meet the requirements of this invention. Non-compressive technologies can produce the desired sheet and roll properties, but not the $CO_2$ equivalent emissions global warming impact. Compressive technologies, such as wet-pressed processes, can produce the requisite $CO_2$ equivalent emissions release, but not the sheet and roll properties.

Example 5

This Invention

Referring to FIG. 1, the following example illustrates the calculation of the $CO_2$ equivalent emissions associated with a method of this invention based on the facts and assumptions set forth below.

A 25 gsm web is formed from a furnish containing 25% northern softwood kraft (NSWK) fiber and 75% bleached eucalyptus (Euc) fiber using a standard twin-wire former. The headbox consistency is 0.1%. The furnish is re-pulped from the dry-lap form with minimal mechanical action and is minimally refined. Hence the WRV is as low as possible for this furnish blend. Starch is added to control the final sheet strength to the desired level.

If the furnish is treated with absolute minimal beating action, as in a controlled lab situation, it might have a blended WRV value of 1.11, calculated as follows:

(1) NSWK WRV=1.25 g/g and Euc WRV=1.10 g/g.

(2) Then, for the 25/75 NWSK/Euc blend, 0.25×1.25+0.75×1.10=1.14 g/g. This is the theoretical minimum WRV for a lab-produced pulp.

However, in a commercial-style hydro-pulper, some degree of "refining" generally will occur when re-pulping the fiber and the resulting WRV of the fibers will be raised due to this unintended beating action. Typically, the re-pulping of the dry-lap pulp will raise the WRV values by approximately 0.2 g/g, such that the overall WRV of the blended furnish will be raised from the 1.14 g/g lab value to approximately 1.34 g/g.

Therefore, the WRV of the furnish of this Example for a commercial tissue machine is 1.34 g/g. The web is formed on a fine-mesh 94M forming fabric, which is traveling 2565 feet per minute (fpm). Consistency dilution is used to control the web formation to a value of 120 or higher. After formation, the web is transferred to a molding fabric using a multi-zone air press. The molding fabric is a three-dimensional fabric with raised machine-direction knuckles as described in FIG. 7 of U.S. Pat. No. 5,672,248, previously incorporated by reference.

The air press has a total active dewatering length of approximately 1.15 inches and is operated in a manner to transfer the web to the molding fabric without the creation of pinholes while simultaneously dewatering the web to a consistency of 23.5 percent. This consistency represents 55 percent of the 42.8 percent WRC associated with the furnish WRV of 1.34 g/g.

The air press is preferably operated with three distinct pressure zones to accomplish the tasks of transfer without pinholes and dewatering. The first zone has an effective length of 0.4 inches and is operated at 4.1 psig pressure to dewater the web from the post-forming consistency (roughly 10 percent) to approximately 15 percent consistency. This zone also serves to transfer the web to the molding fabric. Since the pressure is low, the web is transferred to the molding fabric without making pinholes in the web.

The next zone, which is located just downstream of the transfer point, has a length of 0.375 inches and is operated at a pressure of 6 pounds per square inch gauge (psig). As the web has already transferred and now is at a consistency of 15 percent, a higher operating pressure can be applied. This 6 psig zone serves to dewater the web from 15 to 19.5 percent consistency.

Finally, the web enters the third zone of the air press and here the operating pressure is higher still, approximately 8 psig. This zone has an active length of 0.375 inches and dewaters the web to 23.5 percent consistency. The water expelled from the web during the dewatering process is captured in a collection box and gravity is preferentially used to drain the water from this box without the aid of vacuum and the accompanying need for additional electrical energy to supply the vacuum.

As the web exits the air press, it is now at 23.5 percent consistency and approximately 14.3 HP per foot of web width have been used to dewater the web. The energy consumed in the dewatering operation is lower than that for a typical TAD process because no vacuum boxes have been used for dewatering and the air press uses less energy than is used in vacuum dewatering. The post-air-press consistency of 23.5 percent represents 55 percent of the WRC associated with the furnish WRV of 1.34. As the web is now at 23.5 percent consistency, it contains 3.26 pounds of water per pound of fiber as it is leaves the air press.

(3) Then 2565 feet per minute×14.7 pounds of fiber/2880 $ft^2$=13.1 pounds of fiber/foot-minute. Dividing this by 14.3 HP per foot yields 0.92 pound fiber/minute-HP or 55.0 pounds fiber/HP-hour.

(4) 55 pounds fiber/HP-hour×(1 HP/0.746 KW)=73.7 pounds fiber/KW-hour (5) Based on a value of 1263 pounds $CO_2$ equivalent emissions per 1000 KW-hour yields 73.7 pounds fiber/KW-hour×1000 KW-hour/1263 pounds $CO_2$ equivalent emissions=58.4 pounds fiber/pound $CO_2$ equivalent emissions.

(6) Using the basis weight of 14.7 pounds/2880 $ft^2$×(1 pound $CO_2$ equivalent emissions/58.4 pounds fiber)×454 grams/pound=0.040 grams $CO_2$ equivalent emissions per $ft^2$, or 1.5 grams $CO_2$ equivalent emissions per 38 $ft^2$ of tissue produced. This value of 1.5 grams $CO_2$ equivalent emissions per 38 $ft^2$ of tissue is the result for the dewatering section (pre-Yankee dryer) of the tissue machine.

Next, the web is transferred to a Yankee dryer. The web is preferably transferred using a wrap transfer with two pressure rolls as shown in FIG. 1. The pressure rolls are both lightly loaded on the Yankee dryer such that the pressure applied to the web is preferably about 5 psi or less and are located such that the web is on the Yankee dryer for a length of about 3 feet between the pressure rolls. The web is transferred in this manner to minimize compression of the web during the transfer operation.

The web is then dried using both the Yankee dryer cylinder and the hood. The Yankee dryer is operated at a steam pressure of 125 psi. In this manner the Yankee dryer cylinder is able to remove approximately 20 pounds of water per square foot of web per hour or alternately, 20 pounds of water per foot of circumference per foot of sheet width.

As the Yankee dryer is 20 feet in diameter, the water removal over the total active length of the dryer is calculated as follows:

(7) ¾×3.14×20 feet×20 pounds of water evaporated per hour per foot of circumference=942 pounds of water per hour per foot of sheet width. The factor "¾" comes from 270 degrees of the Yankee dryer cylinder being active for drying.

In other words, the dead space between the creping blade and the first pressure roll represents ¼ of the dryer circumference.

(8) The incoming web carries 13.1 pounds fiber per minute per foot of width×3.26 pounds of water per pound of fiber×60 minutes per hour=2562 pounds of water per hour per foot of width. As the Yankee dryer cylinder can remove 942 pounds of water per hour per foot of width, the water left after taking into account the Yankee cylinder drying is 2562−942=1620 pounds of water/hour per foot of width. In this manner, the Yankee dryer cylinder alone increases the web consistency from the incoming 23.5 percent to 32.7 percent at the creping blade.

(9) The consistency of 32.7 percent=100×(786 pounds of fiber/hour-foot/(786 pounds fiber/hour-foot+1620 pounds water/hour-foot)).

(10) The energy consumption on the Yankee dryer cylinder is approximately 1400 BTU per pound of water. The total energy consumption associated with removing the 942 pounds of water is 942 pounds/foot-hour×1400 BTU per pound of water=1,318,800 BTU/foot width-hour.

In addition to the Yankee dryer cylinder, drying is accomplished by a high-velocity hood that is operating associatively with the Yankee cylinder. The hood provides heated air at a temperature of approximately 1000° F. The hood removes the remaining 1581 pounds of water per foot of width to bring the web consistency to a value of roughly 95 percent when the web is removed from the dryer via creping.

(11) The value of 1581 comes from 1620 pounds of water/hour-foot minus the 39 pounds of water/hour-foot associated with the final consistency of 95 percent (5 percent of 786 pounds of fiber/hour-foot).

(12) The gas energy consumption in the hood is approximately 2200 BTU/pound of water or a total of 1581 pounds water/foot per hour×2200 BTU/pound of water=3,478,200 BTU per foot of width per hour.

Both the hood and the Yankee cylinder are gas fired, that is, their energy is supplied via the burning of gas. As such, the conversion factor is 123 pounds $CO_2$ equivalent emissions per 1 MM BTU for this gas source.

(13) Then, (1,318,800 BTU/hour-foot from the Yankee cylinder+3,478,200 BTU/hour-foot from the hood)×123 pounds $CO_2$ equivalent emissions per 1,000,000 BTU=590.0 pounds $CO_2$ equivalent emissions per hour-foot of sheet width.

(14) Since 786 pounds of fiber per hour per foot are being produced, this translates to 786 pounds of fiber/hour-foot/590 pounds $CO_2$ equivalent emissions per hour per foot of sheet width=1.33 pounds of fiber/pound of $CO_2$ equivalent emissions.

(15) Then 14.7 pounds of fiber/2880 $ft^2$×(1 pound $CO_2$ equivalent emissions/1.33 pounds of fiber)×454 grams/pound=1.74 gram $CO_2$ equivalent emissions per $ft^2$ of tissue produced.

(16) 1.74 grams $CO_2$ equivalent emissions per $ft^2 \times 38\ ft^2/38\ ft^2$=66.2 grams $CO_2$ equivalent emissions per 38 $ft^2$ of tissue.

The hood also requires electricity to force the heated air through the system. The hood utilizes a variable speed fan to minimize the amount of energy used to force the heated air through the system. As such, the fan utilizes approximately 300,000 BTU/metric ton of product and the $CO_2$ equivalent emissions release from this fan is calculated as follows:

(17) 300,000 BTU/2200 pounds fiber×(0.293 KW-hour/1000 BTU)=0.04 KW-hour/pound fiber.

(18) 0.04 KW-hour/pound fiber×(1263 pound $CO_2$ equivalent emissions/1000 KW-hour)=0.05 pounds $CO_2$ equivalent emissions/pound fiber.

(19) Then 14.7 pounds of fiber/2880 $ft^2$×(0.05 pound $CO_2$ equivalent emissions/1 pound of fiber)×454 grams/pound=0.116 gram $CO_2$ equivalent emissions per $ft^2$ of material produced.

(20) 0.116 grams $CO_2$ equivalent emissions per $ft^2 \times 38\ ft^2/38\ ft^2$=4.4 grams $CO_2$ equivalent emissions per 38 $ft^2$ tissue.

Adding the $CO_2$ equivalent emissions from the dewatering zone (i.e. 1.5 grams per 38 $ft^2$ tissue) plus the $CO_2$ equivalent emissions from the hood fan (4.4 grams per 38 $ft^2$ tissue) to the $CO_2$ equivalent emissions due to gas energy consumption for the Yankee (66.2 grams per 38 $ft^2$ tissue) yields a total energy consumption of approximately 72.1 grams $CO_2$ equivalent emissions per 38 $ft^2$ tissue. This is the total $CO_2$ equivalent emissions for the production of this tissue.

After drying, the web can be conveyed to a reel and wound into a parent roll. It can then be converted into bathroom tissue using standard converting techniques. The final product is a single-ply bath tissue produced using about 72.1 grams $CO_2$ equivalent per 38 square feet of tissue and having a basis weight from about 25 grams per square meter and a Formation Index of about 120 or greater. The Formation Index can be controlled by the particular forming fabrics selected and the speed of the machine, as well as the basis weight and fiber type. The Vertical Water Absorbent Capacity can be about 9 grams of water or greater per gram of fiber, which will depend in part on the particular molding fabric chosen. Similarly, after converting, the roll bulk can be about 10 cubic centimeters or greater per gram of fiber and will depend specifically on the molding fabric chosen and the chosen winding tension.

Factors that will decrease the $CO_2$ equivalent emissions per 38 square feet of tissue relative to the calculated value of 72.1 grams set forth in the foregoing Example 5 include: improved sheet formation through former design and/or reduced forming consistency; reduced basis weight (a lower basis weight product requires less drying energy from the Yankee and hood, but is partially offset by increased dewatering energy); use of a molding fabric that minimizes pinholes in the web while still providing the necessary sheet caliper; use of dewatering or drying technologies that create less $CO_2$ equivalent emissions; reduced loss of "wasted" energy in the process such as losses through the Yankee heads; and reduced consistency at the Yankee creping blade. Additional factors well known to those skilled in the art of tissue making might also be used to further reduce the $CO_2$ equivalent emissions.

Conversely, factors that will increase the $CO_2$ equivalent emissions per 38 square feet of tissue relative to the calculated value of 72.1 grams set forth in Example 5 include: poorer formation due to an inherently poorer former (such as a suction breast roll former); poorer formation due to increased forming consistency; lack of consistency dilution to correct poor formation; use of a molding fabric and/or transfer vacuum that leads to pinholes in the web; increased basis weight (due to the greater drying energy requirements but partially offset by lower dewatering energy); more wasted energy such as increased losses through the Yankee heads; and increased consistency at the creping blade. Additional factors, well known to those skilled in the art of tissue making, might tend to increase the $CO_2$ equivalent emissions.

It will be appreciated that the foregoing example, given for purposes of illustration, is not to be construed as limiting the scope of this invention, which is defined by the following claims and all equivalents thereto.

We claim:

1. A method of making a roll of tissue comprising:

(a) forming a wet tissue web from an aqueous suspension of papermaking fibers, said papermaking fibers having a Water Retention Value of about 1.5 grams of water or less per gram of fiber;

(b) dewatering the wet web to a consistency from about 50 to about 65 percent of the Water Retention Consistency of the wet web; wherein the wet web is dewatered with a multi-zone air press;

(c) transferring the dewatered web to a molding fabric, wherein the dewatered web conforms to the surface of the molding fabric to form a molded wet web;

(d) transferring the molded wet web to the surface of a hooded Yankee dryer;

(e) drying the web to a consistency of about 90 percent or greater and creping the dried web to produce a tissue sheet having a basis weight from about 25 to about 40 grams per square meter, a Formation Index of about 110 or greater, and a Vertical Water Absorbent Capacity of about 9 grams of water or greater per gram of fiber, wherein the total $CO_2$ equivalent emissions per 38 square feet of tissue used for dewatering and drying the tissue sheet is from about 60 to about 100 grams; and (f) converting the tissue sheet into a roll of single-ply tissue having a roll bulk of about 10 cubic centimeters or greater per gram of fiber.

2. The method of claim 1 wherein the molded wet web is transferred to the surface of the Yankee dryer via a long wrap transfer.

3. The method of claim 1 wherein the wet tissue web is formed with a twin-wire former.

4. The method of claim 1 wherein the molded wet web is transferred to the surface of a Yankee dryer with a pressing pressure of about 5 pounds or less per square inch of the web.

5. The method of claim 1 wherein the Formation Index is from about 120 to about 170.

6. The method of claim 1 wherein the web is dried to a consistency of about 95 percent or greater.

7. The method of claim 1 wherein the total $CO_2$ equivalent emissions per 38 square feet of tissue used for dewatering and drying the tissue sheet is from about 70 to about 100 grams.

8. The method of claim 1 wherein the total $CO_2$ equivalent emissions per 38 square feet of tissue used for dewatering and drying the tissue sheet is from about 70 to about 80 grams.

9. The method of claim 1 wherein the $CO_2$ equivalent emissions per 38 square feet of tissue used for dewatering the web is from about 1 to about 5 grams.

10. A method of making a roll of tissue comprising:

(a) forming a wet tissue web from an aqueous suspension of papermaking fibers using a twin-wire former, said papermaking fibers having a Water Retention Value of about 1.5 grams of water or less per gram of fiber;

(b) dewatering the wet web with a multi-zoned air press to a consistency from about 50 to about 65 percent of the Water Retention Consistency of the wet web; wherein the wet web is dewatered with a multi-zone air press;

(c) transferring the dewatered web to a molding fabric, wherein the dewatered web conforms to the surface of the molding fabric to form a molded wet web;

(d) transferring the molded wet web to the surface of a hooded Yankee dryer with a pressing pressure of about 5 pounds or less per square inch of the web;

(e) drying the web to a consistency of about 95 percent or greater and creping the dried web to produce a tissue sheet having a basis weight from about 25 to about 40 grams per square meter, a Formation Index of about 120 or greater, and a Vertical Water Absorbent Capacity of about 9 grams of water or greater per gram of fiber, wherein the total $CO_2$ equivalent emissions per 38 square feet of tissue used to dewater and dry the tissue sheet is from about 60 to about 100 grams; and (f) converting the tissue sheet into a roll of single-ply tissue having a roll bulk of about 10 cubic centimeters or greater per gram of fiber.

11. The method of claim 10 wherein the molded wet web is transferred to the surface of the Yankee dryer via a long wrap transfer.

12. The method of claim 10 wherein the total $CO_2$ equivalent emissions per 38 square feet of tissue used for dewatering and drying the tissue sheet is from about 70 to about 80 grams.

13. The method of claim 10 wherein the $CO_2$ equivalent emissions per 38 square feet of tissue used for dewatering the web is from about 1 to about 2 grams.

* * * * *